United States Patent [19]

Schmale

[11] Patent Number: 4,611,517

[45] Date of Patent: Sep. 16, 1986

[54] PROCESS AND APPARATUS FOR CONTINUOUS LENGTHWISE CUTTING OF A PILE WEB

[75] Inventor: Carl Schmale, Ochtrup, Fed. Rep. of Germany

[73] Assignee: Carl Schmale GmbH & Co. KG, Ochtrup, Fed. Rep. of Germany

[21] Appl. No.: 692,903

[22] Filed: Jan. 18, 1985

[30] Foreign Application Priority Data

Feb. 3, 1984 [DE] Fed. Rep. of Germany ..... 3403710

[51] Int. Cl.[4] ..... D06H 7/04

[52] U.S. Cl. ..... 83/56; 83/102.1; 83/368; 83/428; 83/433

[58] Field of Search ..... 83/13, 56, 156, 102.1, 83/368, 370, 371, 425, 428, 433, 508

[56] References Cited

U.S. PATENT DOCUMENTS 2,910,122 10/1959 Anderson et al. ..... 83/368
3,664,223 5/1972 Brocklehurst ..... 83/368
3,753,381 8/1973 Reime et al. ..... 83/368 X

FOREIGN PATENT DOCUMENTS 1335477 10/1973 United Kingdom ..... 83/368

*Primary Examiner*—James M. Meister
*Assistant Examiner*—John L. Knoble
*Attorney, Agent, or Firm*—Karl F. Ross; Herbert Dubno

[57] ABSTRACT

A process for continuous cutting of a pile fabric web, having at least one comparatively narrow loopless or napless zone running lengthwise thereon between napped or looped surfaces, lengthwise in the exact center of one of the loopless or napless zones. The fabric web is fed lengthwise along a transport path to the motorized cutting device. The position of the cutting device transverse to the feed direction of the fabric is adjusted automatically so that the loopless and napless zone is cut lengthwise along its exact center by coupling the device with a sensor shoe or slider which senses, e.g. by direct contact, the edges of the pile adjoining this zone.

32 Claims, 15 Drawing Figures

PROCESS AND APPARATUS FOR CONTINUOUS LENGTHWISE CUTTING OF A PILE WEB

FIELD OF INVENTION

My present invention relates to a process and to an apparatus for the continuous lengthwise (longitudinal) cutting of a pile web, e.g. of carpeting or pile fabric which has a comparatively narrow napless or loopless (pile-free) zone running lengthwise between pile regions having napping or looping and, more particularly, to a process and an apparatus for cutting lengthwise a fabric web exactly in the center of at least one napless or loopless pile-free zone running lengthwise thereon.

BACKGROUND OF THE INVENTION

In prior art systems the pile fabric web is generally continuously fed to a motor-driven cutting apparatus. In one previously known apparatus of this kind the fabric web is fed over rotating rollers most of which have mutually parallel axes and is held firmly thereon with longitudinal prestress. A motorized cutting device is supported adjustably transverse to the feed direction of the fabric web in a supporting structure also containing the fabric web transport apparatus arranged so that the manually controlled cutting device cuts to the greatest extent possible along the napless or loopless pile-free zone.

On account of variable pretension of the fabric web or deviation of the actual feed direction of the fabric web from the correct feed direction, which can result also, among other things, from varying pretension of the fabric web, the actual feed direction of the fabric web must be controlled by an operator and the cutting apparatus is adapted to the actual feed direction of the fabric web as needed to at least approximately cut the fabric web lengthwise along the center of the napless or loopless zones.

These measures are extremely laborious, while on the other hand the prior art apparatus requires excessive concentration and reaction abilities of the operator so that cuts running somewhat crooked and off center frequently result.

OBJECTS OF THE INVENTION

It is, therefore, the principal object of the invention to provide a process for cutting a nap or pile fabric web exactly along the center of a napless or loopless zone formed on the loom and running lengthwise thereon, and also to provide an apparatus for accomplishing this so that a straight and central cut of the fabric web is achieved with a reduction of operating costs and with greater precision and freedom from defects.

It is another object of my invention to provide an improved process and apparatus for cutting a fabric web having relatively narrow napless or loopless pile-free zones running lengthwise thereon, longitudinally in the exact center of the pile-free zone automatically without manual intervention during the cutting operation.

It is a further object of this invention to reduce the cost of cutting fabric webs lengthwise exactly along the center of a comparatively narrow napless or loopless zone running lengthwise thereon by eliminating the need for a manual operator intervention by providing a means for automatically positioning a cutting device transversely to the feed direction of the fabric web so that the cut can be kept exactly centered during the automated cutting operation.

SUMMARY OF THE INVENTION

These objects and others which will become apparent hereinafter are obtained in accordance with the invention in a process for the continuous longitudinal cutting of a nap or pile fabric web, having at least one comparatively narrow loopless or napless pile-free zone running longitudinally thereon between napped or looped pile surfaces in the exact center of the pile-free zone and which comprises feeding the fabric web longitudinally along a transport path to a fabric cutting device and controlling the position of the cutting knife or blade of the cutting device transverse to the web-feed direction so that the pile-free zone is cut lengthwise along the exact center of the zone.

In the discussion which follows I will refer to a slider which will be understood to mean the sensor for the zone and its edges.

According to my invention the relative position of the cutting knife of the cutting apparatus and the center of the loopless or napless zone of the fabric strip is controlled by a slider (position sensor or sensing shoe) which rides on the pile-free zone and detects, monitors or feels continuously both of the pile edges bordering the pile-free zone and thus positions the blade at the exact center of the zone between these edges to provide a continuous linear central cut of the pile-free or loopless zone.

I am able thereby to reduce operating costs by eliminating waste, unnecessary stoppages and frequent operator intervention during the cutting process.

The slider, sensor or shoe may advantageously be either a mechanical or an electrical sensor communicating electronically with a means for shifting the cutting knife of the cutting apparatus transverse to the fabric feed direction.

In any case the cutting device is no longer mounted to be independent of the actual feed direction of the fabric web and will be positively (forcibly) directed down the center of the napless or loopless zone automatically to accordingly cut that zone centrally.

The invention also provides a fabric cutting apparatus for continuous longitudinal cutting of the pile fabric web along the exact center of one of its pile-free zones, wherein the fabric web is prestressed lengthwise (i.e. is longitudinally pretensioned) over at least two motor driven rotatable rollers spaced from one another and having parallel axes to define a longitudinal transport path for the web, and wherein a motor driven cutting device is mounted for movement transverse to the feed direction of the fabric web and has a blade engaging the fabric web between these rollers.

According to the apparatus aspect of the invention:

(a.) at least one sensing slider or shoe is positioned above the fabric web and its transport path;

(b.) the slider is pressed onto and rides upon the pile-free zone of the fabric web and is mounted for movement transversely to the feed direction of the fabric web;

(c.) the slider is constructed and arranged to simultaneously sense both pile edges bordering and defining the pile-free zone of the fabric web to be cut; and (d.) the slider is operatively coupled at least indirectly with the cutting device to effect shifts in position of the cutting knife or blade transverse to the fabric feed direction so as to maintain this blade precisely centered between these edges.

In this way the slider is held in engagement on the fabric web to follow the course of the napless or loopless fabric web zones exactly, so that the fabric web will be cut centrally lengthwise along the napless or loopless zone.

According to the invention the slider is adjustable in width so that it can be easily fitted to fabric webs having different width napless or loopless zones and different looping and napping heights. This adjustment of the slider width may be accomplished by attaching runners shaped for example like gutters or skids to each of the long edges of the slider by bolts engaging transverse elongated slots in the runners so that the runners may be extended transversely to the fabric feed direction.

The simple and convenient manufacturing process, which provides automatic positive guidance of the slider along the napless and loopless zone and uses a slider and cutting device having minimal friction at the working surfaces, suspends the slider and the cutting device with stability in the support structure so that they are pivoted under the force of gravity so as to be inclined toward the feed direction of the inclined fabric web as well as shiftable transverse to the feed direction of the fabric web. A further feature of this novel apparatus is universal joint linking supports for the slider and cutting apparatus, especially a four-pivot parallelogrammatic linkage with a universal joint at each pivot.

So that the transverse adjustments of the cutting device will have reduced inertia, the drive motor of the cutting device can be fixed on the support structure and be connected with the cutting knife by a suitable flexible coupling member, for example a flexible drive shaft, a universal-joint shaft or the like. Then only the cutting knife and its immediate supports instead of the comparatively heavy motor need be shifted across the fabric web transversely.

Advantageously, in the above described apparatus an exact alignment of the slider relative to the napless or loopless fabric zone is assured by mounting the slider upon a bracing arm attached to the pivotally supported cutting apparatus and directed in the direction opposite to the fabric web feed direction.

It is also advantageous for the slider to be supported freely rotatable at its points of attachment on the bracing arm about a horizontal axis perpendicular to the feed direction of the fabric web, so that at all times the body of the sensor, slider or feeler is held securely on the napless or loopless zone of the fabric web.

A further improvement results from providing a support for the feeler on the opposite side of the web, the support being connected to the blade-carrying member by a respective arm extending through the slit formed by the blade. I thus can provide a double slider comprising coincident, similar sliders opposing one another, one positioned above the napless or loopless zone of the fabric, the other attached to the former slider but positioned below the fabric so that the fabric slides between the two sliders of the double slider or sensor. Where one slider forms the sensor, the other provides the opposing support member.

Additional operational reliability for the previously described slider may be attained by providing a guide peg shaped like an inverted letter T and positioned with its stem protruding upwardly through and attached to the slider or the double slider so as to help hold the double slider together and to the napless or loopless zone of the fabric web by holding the fabric or the lower slider upwardly in the upwardly pressing arms of the inverted T shaped guide peg.

In this case, preferably, the slider and the guide peg can be constructed to be adjustable relative to one another in order to be able to cut different thickness fabric webs safely exactly along the center of the napless or loopless zone.

According to a feature of the invention the slider is attached to the guide peg by means of leaf springs mounted on the top of the slider, the leaf springs being attached in their center portions to the upper portion of the stem of the inverted T shaped guide peg. The springs act to press the guide peg upwardly holding, for example, the double slider together and to the fabric. The fabric web has also on its underside lengthwise running napless and loopless zones running between surfaces having napping and looping thereon, so that a good cut may be obtained especially if the arms of the inverted T shaped slider are of a width which substantially conforms to the width of the napless or loopless zones.

It is also particularly advantageous if the slider is constructed with a central lengthwise slot so that the cutting knife of the cutting apparatus may penetrate and cut through the slider.

Further a substantially wedge shaped feed stabilizer having an arrow-head-like cross section can be attached at its tip to the end of the slider directed toward the fabric feed direction. The feed stabilizer protrudes above and below the slider but is beveled on its lower side facing the fabric web so as to engage the cut in the fabric web and help stabilize the motion of the fabric web through the slider.

When the entire cutting device and the slider are shifted transverse to the feed direction of the fabric web to attain an exactly centered cutting of the napless or loopless zone, the cutting device with its accompanying slider is advantageously mounted on a feed guide so as to be freely movable transverse to the fabric feed direction.

The feed guide comprises preferably a pair of feed bars mounted transverse to the fabric feed direction and parallel to one another and spaced from each other by a distance of the order of the width of the cutting device or more and a carriage to which the cutting device is attached, the carriage having attached perpendicular thereto support arms extending toward the feed bars having guide wheels positioned thereon so that the carriage structure is retained on and can be moved along the feed bars with its attached cutting device.

Under circumstances when reliable cutting is especially difficult and/or with fabric webs with relatively lower napless or loopless zones, electronic sensors may be provided and a servomotor responding to these sensors is coupled to the cutting device, so that the slider need only provide the control signal which travels to a servocontrol mechanism which shifts automatically the position of the cutting knife of the cutting apparatus to attain a reliable central cut.

BRIEF DESCRIPTION OF THE DRAWING

The above and other objects, features and advantages of the invention will become more readily apparent from the following detailed description, reference being made to the accompanying drawing. Several specific embodiments of this invention are shown in the drawing in which.

SPECIFIC DESCRIPTION

Figure 1:
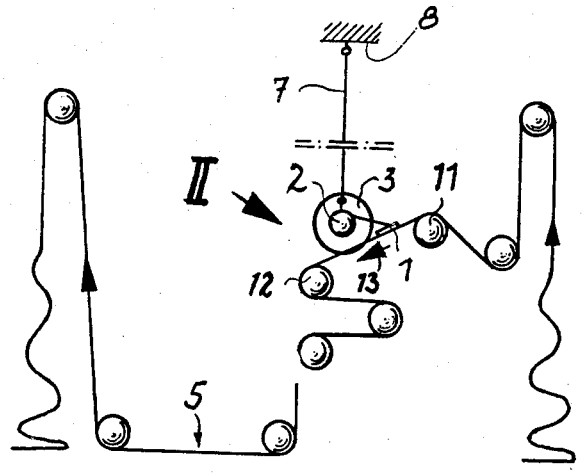
FIG. 1 is a schematic side view of the entire apparatus for continuous lengthwise cutting of a fabric web.
Figure 2:
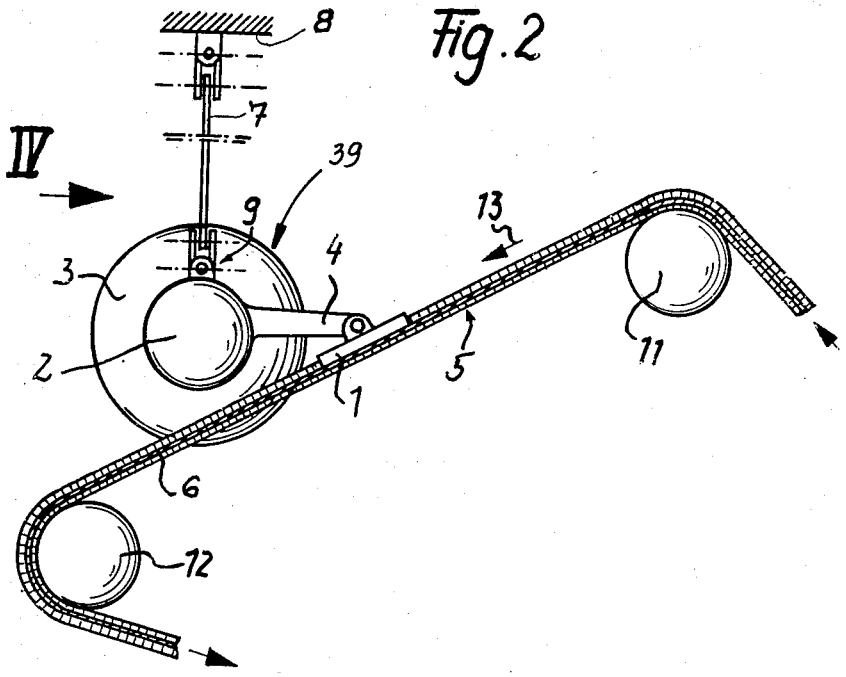
FIG. 2 is an enlarged view of the portion II of FIG. 1 showing one embodiment of the novel cutting device of this invention.
Figure 3:
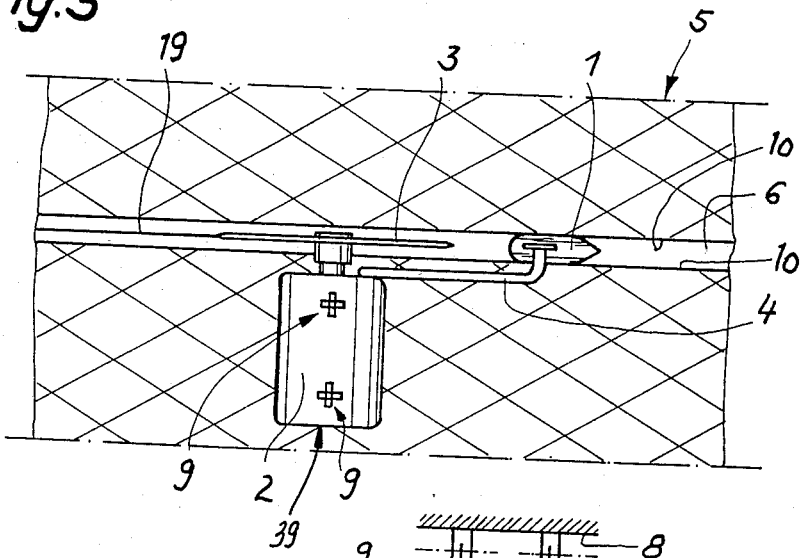
FIG. 3 is a top view of the apparatus of FIG. 2 including the novel slider.
Figure 4:
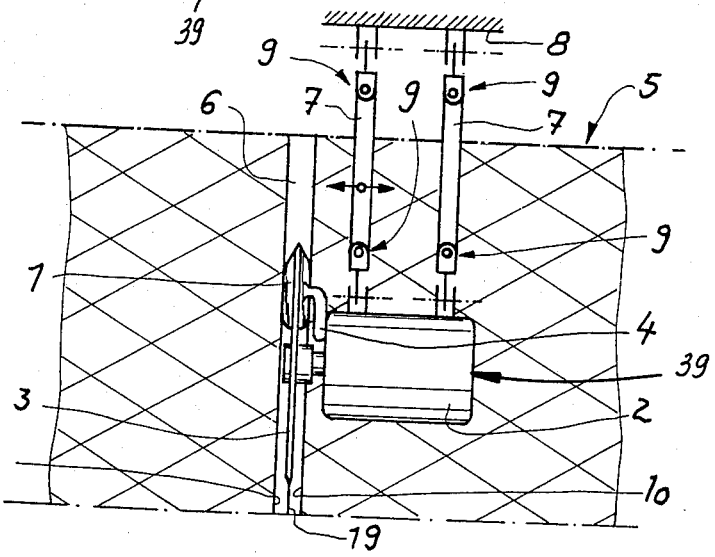
FIG. 4 is a side view of the apparatus of FIG. 2 seen in the direction of arrow IV of FIG. 2.

The apparatus shown in FIGS. 1 to 4 for continuous lengthwise cutting of a fabric web, especially sponge or pile fabric, which has comparatively narrow napless or loopless zones running lengthwise thereon between surfaces having napping or looping (needled or looped threads forming the pile) and which should be cut centrally, is provided with a skid-like or runner-like sensor in the form of a slider 1 tapered toward its front end, that is the end directed opposite to the fabric feed direction, and constructed and arranged for automatic directional alignment of the cutting device 39.

This slider 1 is held opposing the feed direction of the fabric web 5 by a bracing arm 4 attached to motor 2 of cutting device 39 with its tapered front end directed opposite to the feed direction.

The slider 1 is pivotally attached at a horizontal axis to the bracing arm 4 so that it is held on top of the whole surface of the napless or loopless zone 6 of the fabric web 5.

The motor 2 and the cutting device 39 are hung from support 8 of the fabric transport apparatus by means of two pivoted guide rods 7 over the fabric web 5 so that the motor 2 is supported by its own weight with its slider 1 pressed on the longitudinal pile-free zone 6 and inclined toward the feed direction on fabric web 5.

Further the guide rods 7 are attached to the support 8 and to the motor 2 with universal joints 9 so that on the one hand the motor 2 together with cutting device 39 pivots in the direction of the fabric web 5, while on the other hand however the cutting device 39 can follow the fed fabric napless or loopless zone 6 since slider 1 presses on the zone 6 while being in continuous engagement with the limiting edges 10 of the napless or loopless zone 6.

The cutting device 39 has a rotatably supported knife 3. The fabric transport apparatus is known in the prior art and has a plurality of rotatable rollers, for example rollers 11 and 12, around and over which the fabric web 5 runs.

At least one of the rollers, which are axially parallel to one another and substantially horizontal, is motor driven, in order to draw the fabric web 5 through the transport apparatus, whereby the fabric web 5 is maintained under tension at least between the rollers 11 and 12.

The cutting device 39 is above and between the rotatable rollers 11 and 12. The rotatable roller 12 is located below the rotatable roller 11 so that the fabric web 5 is inclined toward the base of the apparatus between rollers 11 and 12. The arrow 13 shows the feed direction of the fabric web 5 which runs from roller 11 to roller 12.

Since the swivel joints 9 permit parallel movement of the motor 2 and its blade to follow the movement of the sensor 1 whose longitudinal edges bear up or are engaged between the edges 10 and the blade is disposed on the longitudinal axial plane of the sensor 1, the blade always cuts the web equidistantly between the edges 10.

Figure 5:
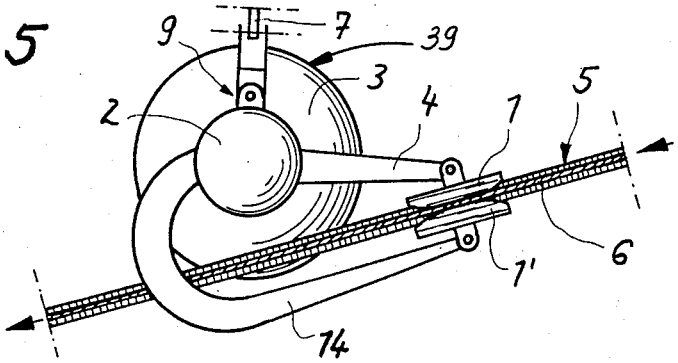
FIG. 5 is a side view of a second embodiment of the invention similar to that shown in FIG. 2.

In FIG. 5 an alternative embodiment is shown in which the cutting device 39 is provided with two sliders 1 and 1′ held opposing one another and between which the napless or loopless zone 6 of the fabric web 5 is pressed.

It is possible of course to refer to the slider 1 as the upper slider since it is above the fabric web surface and the slider 1′ as the lower slider. The fabric web 5 also has on its underside a pile-free zone between looped and napped surfaces similar to the upper zone 6 having no naps or loops and along which the slider 1′ rides. Both these napless and loopless zones are defined between pile edges, for example edges 10, which engage and center the upper slider 1 and the lower slider 1′.

The slider 1′ is attached to motor 2 of the cutting device 39 by curved arm 14 which has a bent portion encircling the cut in the fabric web 5 to press lower slider 1′ up against the fabric web 5.

Figure 6:
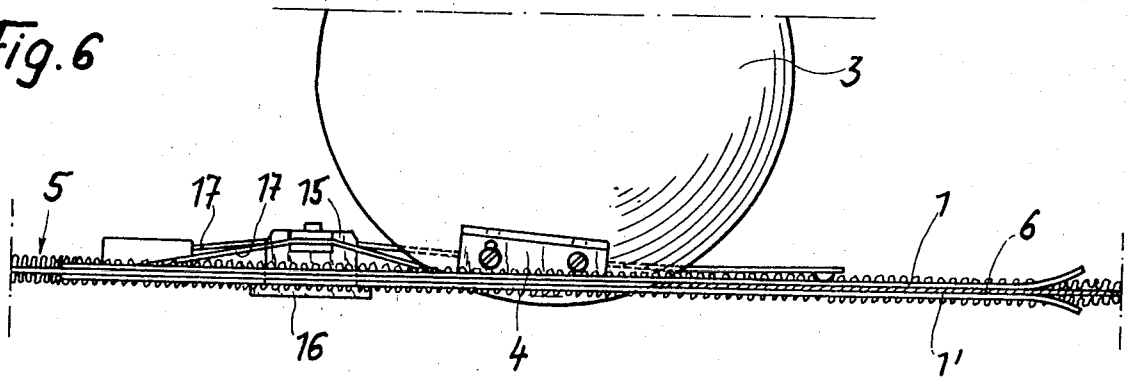
FIG. 6 is a side view of a further refinement of the invention showing the novel sliders in detail.
Figure 8:
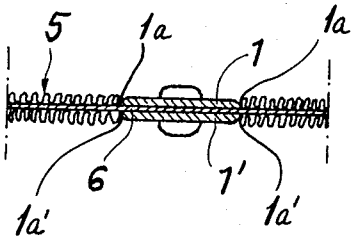
FIG. 8 is a cross sectional view of the embodiment of FIG. 6 taken along the line VIII—VIII of FIG. 7.
Figure 7:
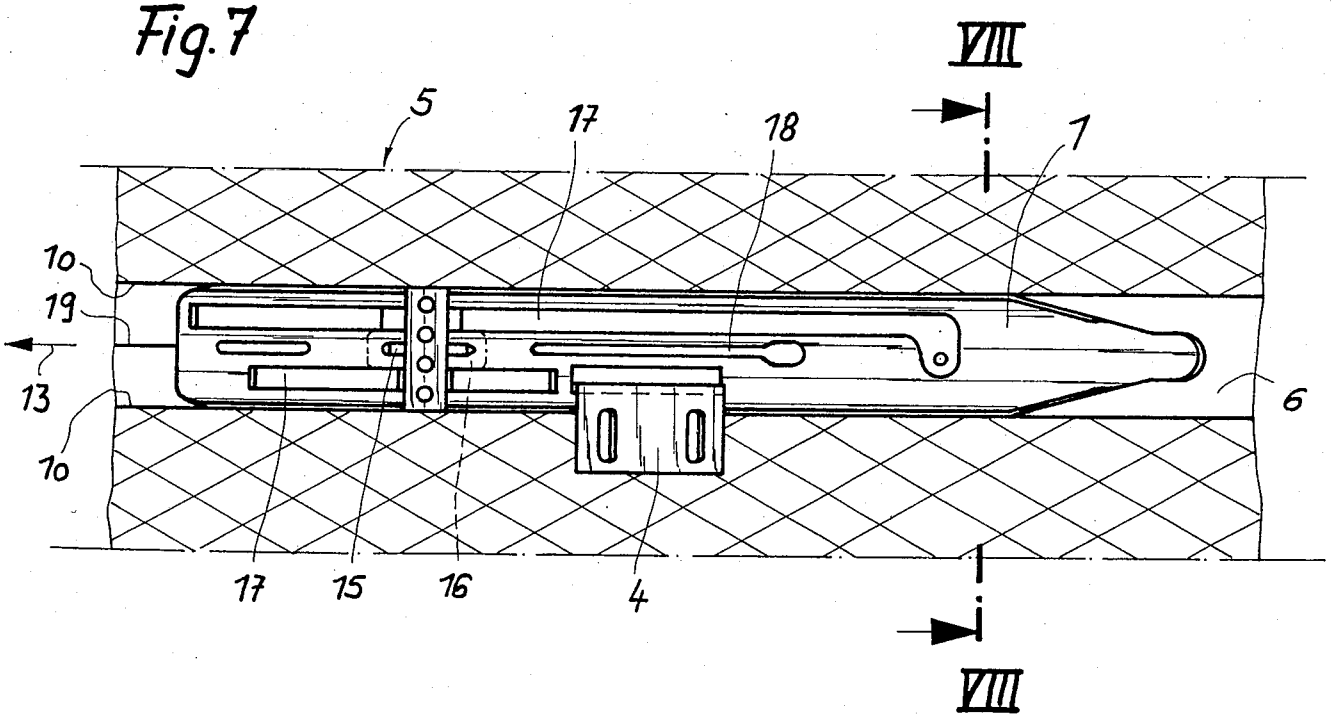
FIG. 7 is a top view of the apparatus of the invention according to the embodiment of FIG. 6.

FIGS. 6 to 8 show a preferred slider embodiment in detail. Herein two substantially equal area sliders 1 and 1′ are positioned coextensive with one another with some clearance therebetween.

Between the two sliders 1 and 1′ a napless or loopless zone 6 of fabric web 5 is held slidably. The width of the double slider or slider 1 and 1′ corresponds exactly to the width of fabric web pile-free zone 6 so that both sliders 1 and 1′ are engaged by the napping or looping border edges 10.

The slider 1 is attached to the bracing arm 4 reaching down from the cutting apparatus 39 as previously described but not shown here. The slider 1′ is held fixed to slider 1 but in such a way so that the fabric web 5 can pass between them. For this purpose a T-shaped cross section, polygonal streamlined guide peg 15 is provided penetrating both sliders 1 and 1′ as well as the cut 19 in fabric web 5 and has supporting head 16 comprising the arms of the T and the upper portion of the stem of the T below the slider 1′.

The spring elements 17 constructed as leaf springs are attached to the upper rear end portion of slider 1 and run lengthwise thereon. These spring elements 17 are also attached to the upper portion of the guide peg 15 protruding up through slider 1 and slider 1′ and thus peg 15 acts to press the sliders 1 and 1′ toward one another.

Further both sliders 1 and 1' have central to each and positioned opposing one another the slots 18 running lengthwise therein, through which the rotatable knife 3 of the cutting apparatus 39 can penetrate to cut the fabric web 5. FIG. 7 shows the cut 19 made by the cutting knife 3 through which the guide peg 15 penetrates. The long edges 1*a*, 1*a'* of sliders 1 and 1' are undercut so that these long edges press on and are supported by the nap and loop edges 10 which are level therewith.

So that the cutting knife 3 of the cutting apparatus 39 may be shifted transverse to the fabric feed direction more easily and reliably, less inertia is preferable to that present in the previously described apparatus.

Figure 15:
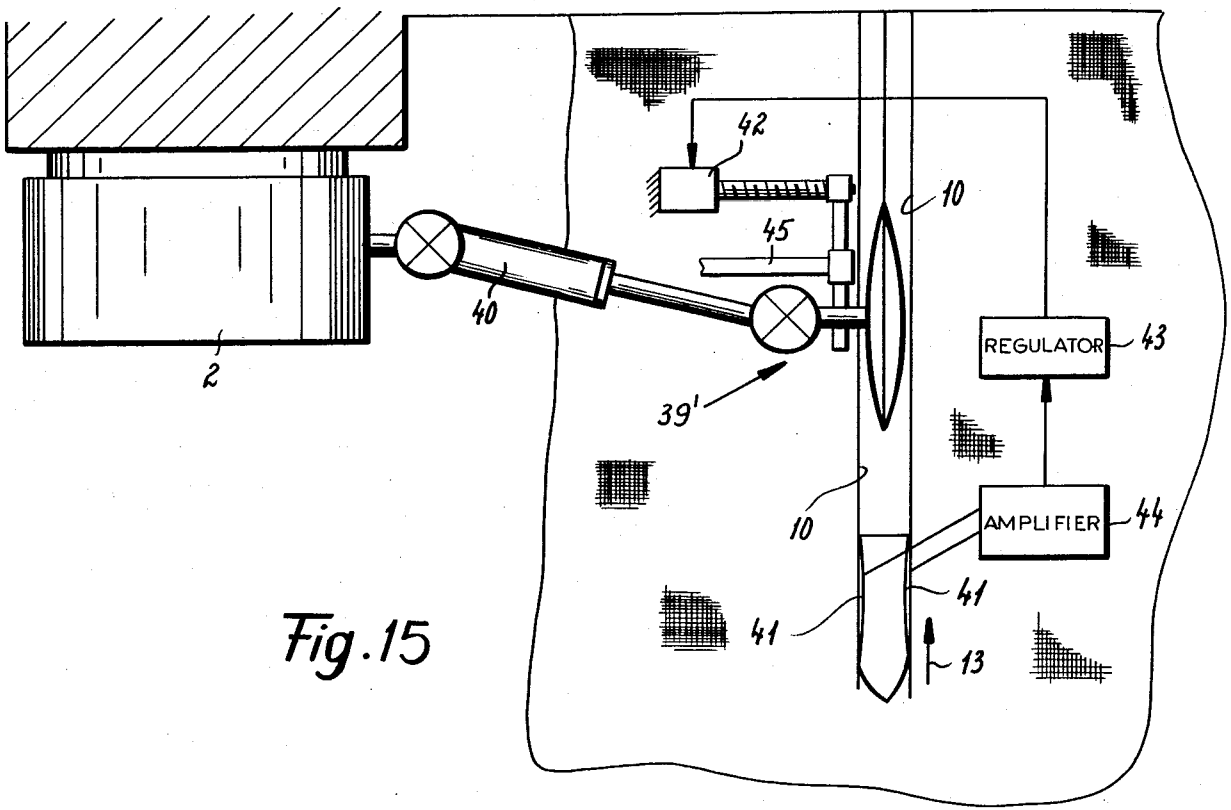
FIG. 15 is a diagram showing another embodiment.

In order to reduce the inertia associated with shifting the cutting knife 3 the motor 2 can be held fixed but the motor drive shaft is connected to the cutting knife 3 by a universal joint shaft 40 (FIG. 15) or a flexible shaft. Under the circumstances it is also advantageous for the slider 1 or 1' to be constructed so as to have electronic proximity sensors 41 and the blade 3 of the cutting device 39 moved under electronic control by a servomotor 42 by a regulating unit 43 on support structure and communicating with the sensors 41 via amplifier 44. Particularly in this case it is possible to support the cutting apparatus 39' adjustably at right angles to the feed direction 13 of the fabric web 5 by a slide bar 45.

Figure 9:
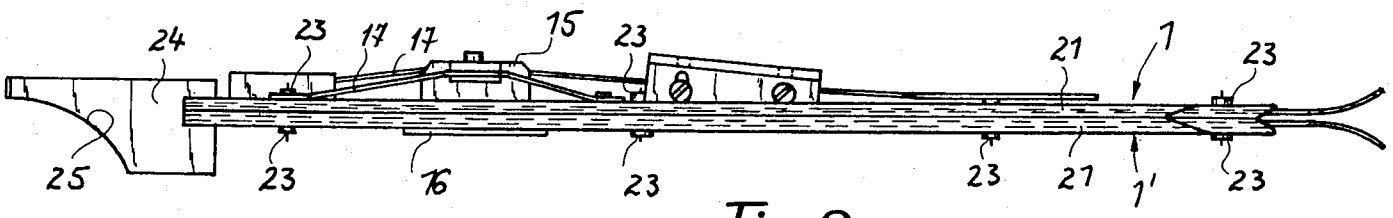
FIG. 9 is a side view of a preferred embodiment of the novel sliders or sensors of this invention.
Figure 10:
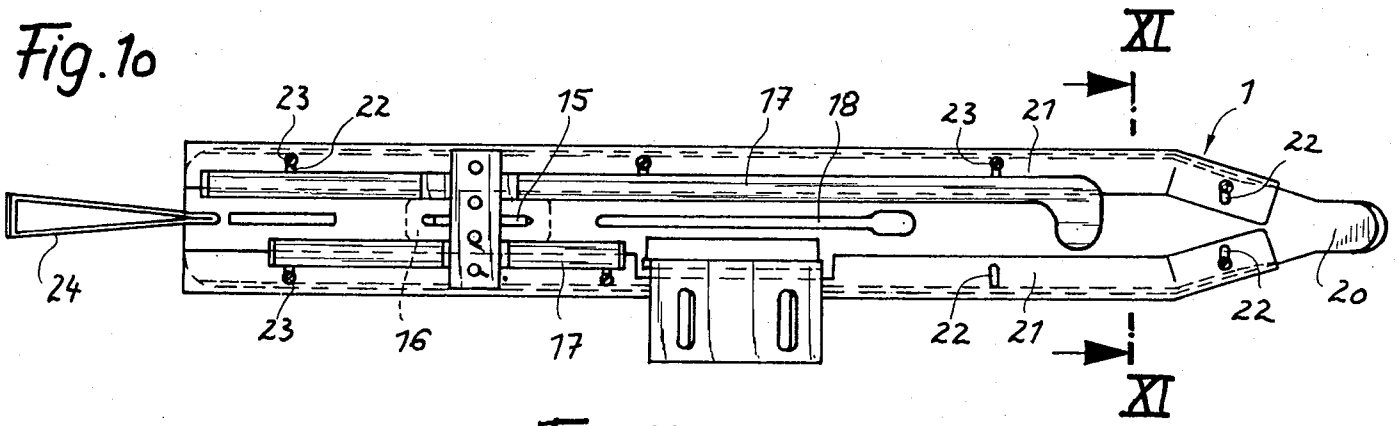
FIG. 10 is a top view of the embodiment of FIG. 9.
Figure 11:
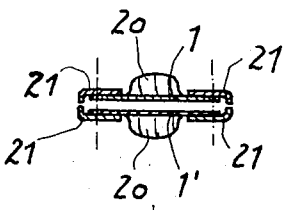
FIG. 11 is a cross sectional view taken along the line XI—XI of FIG. 10.

According to a further embodiment of this invention as shown in the FIGS. 9 to 11, two sliders 1 and 1' are positioned coextensively or in registry over the other but spaced apart with clearance.

Both sliders 1 and 1' comprise a pair of equally thick rails running with their long sides parallel to one another the entire length of sliders 1 and 1'.

The end portion 20 of the sliders 1 and 1' is tapered in the direction opposed to the feed direction of the fabric web 5 and is formed bowed and bent away from the fabric web 5. Both sliders 1 and 1' are similar therefore in shape to a ski.

On the long edges of the slider 1 and 1' the runners 21 attach and reach to the end portion 20 to cover the long edges of sliders 1 and 1'. The runners 21 are slidable transversely to the long side of slider 1 and 1' but fixed in the longitudinal direction. Thus the effective width of slider 1 and 1' can be continuously varied to fit a particular width of a particular napless or loopless zone 6 of the fabric web 5. By the narrow runner 21 a reliable travel along the napped or looped border edges 10 of the fabric web 5 will result.

For holding the runner 21 fixed to the slider 1 or 1' slots or holes 22 through the outer flange of the gutter shaped runners 21 can be provided. These slots or holes 22 are not circular but are elongated transverse to the fabric feed direction so that the runner 21 is adjustable transverse to the fabric feed direction.

Through each slot 22 a threaded bolt 23 is fed so that its head bears against the runner 21 and the threaded shank of bolt 23 is screwed into a tapped hole in the slider 1 or 1'.

The longitudinal edges of runners 21 are advantageously sharp-edged so that the runners 21 can effectively engage the edges 10 of pile-free zones 6 where the pile angularly adjoins the supporting fabric.

Preferably the runners 21 are, as shown in FIG. 11, angular in profile, whereby a first shank of runner 21 is affixed to the outside of slider 1 or 1', while a second shank or flange is directed toward the fabric web 5. The first and second flanges of runners 21 are positioned at an obtuse angle to one another. Moreover it is for the reliable engagement of the loop and nap edges 10 that the free outer long edges of the second runner flange 21 are constructed with sharp edges.

This embodiment is especially suitable for fabric webs 5 with comparatively less thick napping or looping zones and correspondingly more labile looping or napping edges. When the runners 21 are narrow they bear particularly effectively on the fabric web 5 and it is accordingly comparatively easy for them to press into and engage the napping and looping edges 10 of the napless and loopless fabric web zones 6. Nevertheless a relatively large runner 21 sliding transverse to the long edges of sliders 1 and 1' is still possible.

Furthermore, a feed stabilizer 24 engageable in the cut 19 in the fabric web 5 is attached in this embodiment to the rear end of slider 1, which penetrates through an unshown slot in slider 1'.

The feed stabilizer 24 widens in the feed direction of the fabric web 5 and has a wedge-shaped cross section.

In the preferred embodiment the wedge angle is comparatively small being only 10°, resulting in an almost arrowhead like cross section taken in the plane of the slider 1 or 1'. The bisecting angle of stabilizer 24 runs through the middle line of the slider 1 or 1'.

Moreover the feed stabilizer 24 projects above the rear outer side of slider 1, wherein this feed stabilizer 24 stands about three thicknesses of the sliders 1 and 1' in height and because it more or less hangs through the fabric web 5 in cut 19, the fabric web 5 is held safely in engagement with the sliders 1 and 1'. The feed stabilizer 24 has its rear underside portion tapered and beveled to form a bow-shaped slope 25, which can brace itself on the cut edges of the cut 19 in the fabric web 5 and thus prevents plunges of the feed stabilizer 24 through the cut 19.

Usually the slider 1 and 1' are equipped as shown in FIGS. 7 to 8.

Figure 13:
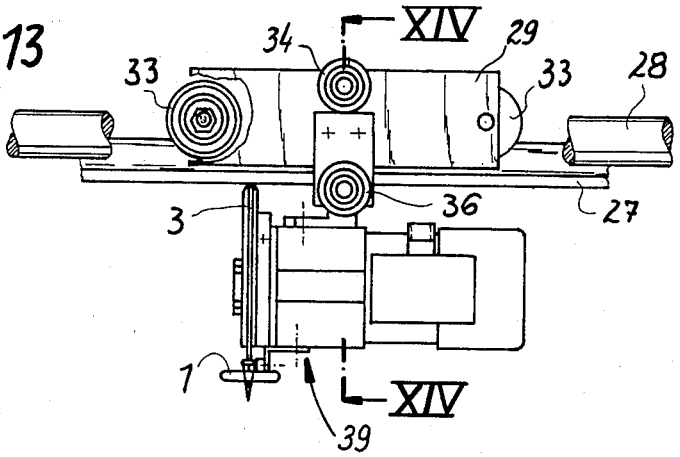
FIG. 13 is a side view of the novel feed guide of FIG. 12.
Figure 12:
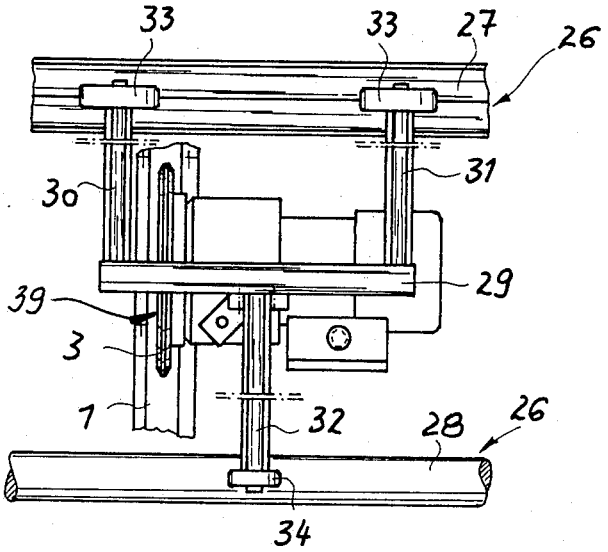
FIG. 12 is a top view of a novel feed guide for transverse adjustment of the position of the cutting device and slider.
Figure 14:
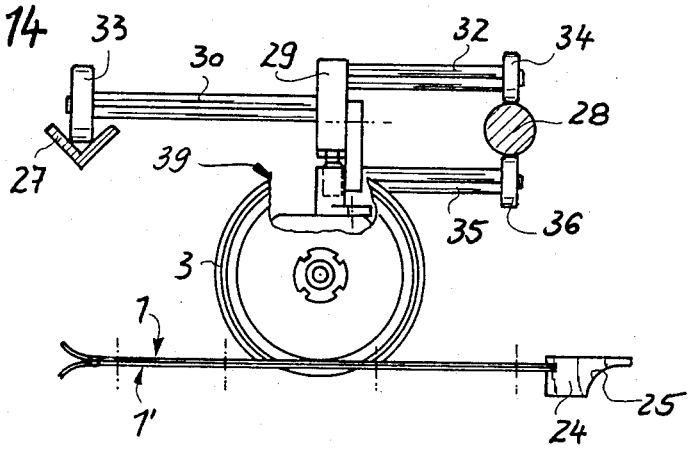
FIG. 14 is a cross sectional view of the embodiment of FIG. 12 taken along line XIV—XIV of FIG. 13, as well as a front view of the invention as a whole.

FIGS. 12 to 14 show how the cutting device 39 together with sliders 1 and 1' as well as the drive motor 2 can be supported slidably on a feed guide 26.

The feed guide 26 comprises two straight feed bars 27 and 28 fixed in side-by-side parallel relation perpendicular to the feed direction 13 of the fabric web 5 and positioned over the fabric web 5.

The length of the feed bars 27 and 28 is greater than the largest width of the previously described apparatus for cutting lengthwise the fabric web 5. The feed bar 27 has along its entire upper surface lengthwise, a preferably angular cross section, open groove, while the feed bar 28 is cylindrical.

The cutting device 39 together with the sliders 1 and 1' as well as the drive motor 2 are stabily suspended from a carriage 29 so that the cutting device 39 and the slider 1 and 1' are equally directed opposite to the feed direction 13 to engage the fabric web 5.

On one long side of carriage 29 facing feed bar 27 two cantilever support arms 30 and 31 are attached at right angles thereto and on the other side of carriage 29 a cantilever support arm 32 is attached at right angles thereto, wherein support arm 32 is positioned preferably centrally with respect to the support arms 30 and 31 which are spaced from one another. The guide wheels 33 are attached rotatably to the ends of support arms 30 and 31 immediately over the gutter or channel of feed bar 27 so as to run in the gutter and similarly a guide wheel 34 is attached rotatably to support arm 32 and positioned so that the carriage 29 may be slid transversely to the fabric web 5 as guide wheels 33 and 34 contact and turn on the support bars 27 and 28.

So that wheel 34 cannot be raised from the feed bar 28 and correspondingly the carriage 29, the carriage 29 is provided with a restraining bar 35 which protrudes from the center of the carriage 29 and is attached thereto preferably immediately below support arm 32, and extends below the underside of feed bar 28 carrying a rotatable retaining wheel 36 positioned so that it presses upwardly on the underside of feed bar 28 so that the carriage 29 can not be displaced upwardly during operation.

The carriage 29 can also be provided with a similar kind of retaining bar, wherein the corresponding retaining wheel should press upwardly on the outer angular fold on the underside of feed bar 27 so that unsafe upward displacements of guide wheel 33 from the feed bar 27 are prevented.

The retaining bar 35 is installed on the carriage 29 so that the feed bar 28 has the retaining wheel 36 positioned on the underside of the feed bar 28 so that the wheel 33 is held on the feed bar 27 with some motion play.

It is desirable to provide the cutting device with a rotatable motor driven knife as shown. It is also possible to use sliders and sensors as described above to provide a rigid blade against which the fabric web 5 runs. The mounting of carriage 29 on the feed guide 26 can occur by prior art roller bearings.

I claim:

1. In a process for the continuous cutting of a pile fabric web, having at least one comparatively narrow pile-free zone running lengthwise thereon between pile surfaces lengthwise in the exact center of said zone, wherein said fabric web is fed lengthwise along a transport path to a continuous cutting device and the position of said cutting device transverse to the feed direction of said web is adjusted so that said zone is cut lengthwise along said exact center of said zone, the improvement which comprises automatically sensing the position of said zone by a slider to sense both pile edges flanking said zone and riding thereon, and communicating a position of the sensed edges transverse to said feed direction of said fabric web to a means for adjusting said transverse position of said cutting device so as to cut automatically said fabric exactly in said center of said zone, said slider being provided with a guide peg protruding upwardly from the underside of said slider through a cut in said fabric web and is shaped to help hold said fabric web to said slider, and wherein said guide peg is T-shaped, a stem of said T-shaped guide peg protruding upwardly through a slot provided in said slider and arms of said T-shaped guide peg being positioned below said cut in said fabric web, said stem of said T-shaped guide peg being attached to the center of two leaf springs attached lengthwise on the upper surface of said slider to provide a means for pressing said cut fabric web upwardly to said slider to provide for a smoother, more reliable cutting operation, and wherein said slider is constructed and positioned so as to be penetrated by a rotatable cutting knife.

2. The improvement defined in claim 1 further comprising a bracing arm attached to said slider and connected mechanically to said cutting device for shifting said cutting device.

3. The improvement defined in claim 1 wherein the sensing is electronic and the position of said cutting device is adjusted automatically under electronic control.

4. In a fabric cutting apparatus for the continuous cutting of a pile fabric web having at least one comparatively narrow pile-free zone running lengthwise thereon between pile surfaces, lengthwise in the center of said zone, wherein said fabric web is advanced along a path in which it is tensioned longitudinally over at least two rotatable rollers spaced from one another and having parallel axes, and a motor driven cutting device is held adjustably transverse to a feed direction of said fabric web and engages said fabric web between said rotatable rollers, the improvement wherein a sensing slider conformed to fit said zone of said fabric web is positioned and pressed on said fabric web to engage said zone, said slider being held adjustably transverse to said feed direction of said fabric web and being constructed to sense both opposite pile edges of said zone, said slider at least indirectly cooperating with said cutting device to adjust the position of said cutting device transverse to said feed direction of said fabric web, said slider being provided with a guide peg protruding upwardly from the underside of said slider through a cut in said fabric web and is shaped to help hold said fabric web to said slider, and wherein said guide peg is T-shaped, a stem of said T-shaped guide peg protruding upwardly through a slot provided in said slider arms of said T-shaped guide peg being positioned below said cut in said fabric web, said stem of said T-shaped guide peg being attached to the center of two leaf springs attached lengthwise on the upper surface of said slider to provide a means for pressing said cut fabric web upwardly to said slider to provide for a smoother, more reliable cutting operation, and wherein said slider is constructed and positioned so as to be penetrated by a rotatable cutting knife.

5. The improvement defined in claim 4 wherein the width of said slider is adjustable.

6. The improvement defined in claim 4 wherein said web is inclined so as to travel downwardly between said rollers, said slider and said cutting device are hung stabily, but pivotally, from a support structure, and said cutting device and said slider are pivoted under the force of gravity in the direction of said fabric web so that said slider engages said zone and is shiftable transversely across the feed direction of said fabric web.

7. The improvement defined in claim 6 wherein said slider and said cutting device are pivotally supported by universal-jointed support bars attached at opposite ends to said cutting device and a support.

8. The improvement defined in claim 7 wherein said support bars form a parallelogrammatic linkage with universal joints.

9. The improvement defined in claim 7 wherein said slider is connected with said cutting device by a bracing arm directed opposite to the feed direction of said fabric web.

10. The improvement defined in claim 9 wherein said slider is freely pivotal on said bracing arm about a horizontal axis perpendicular to said feed direction of said fabric web.

11. The improvement defined in claim 4 wherein said cutting device has a drive motor which is held fixed and is connected with a blade of said cutting device by a flexible mechanical coupling member.

12. The improvement defined in claim 11 wherein said coupling member is a universal joint shaft.

13. The improvement defined in claim 4 wherein said slider and said guide peg are adjustable relative to one another.

14. The improvement defined in claim 4 wherein said cutting device is provided with a motorized, rotatable cutting knife.

15. The improvement defined in claim 4 wherein said slider is an electronic sensor and a motor driven coupling member controlled by said electronic sensor adjusts the position of said cutting knife across said fabric web.

16. The improvement defined in claim 15 wherein said sensor is a contactless electronic sensor.

17. The improvement defined in claim 4 wherein the length of said slider is substantially eight times the width thereof.

18. The improvement defined in claim 4 wherein said slider is constructed from two rails having long edges lengthwise parallel to one another, an end portion of the slider directed opposite to the feed direction of said fabric web being tapered and bowed away from a plane of said fabric web.

19. The improvement defined in claim 18 wherein narrow runners are positioned on longitudinal edges of said slider and have side portions turned toward the surface of said fabric web over the edges of said slider, said runners having a width smaller than half the width of said slider.

20. The improvement defined in claim 19 wherein said runners extend along the longitudinal edges of said slider to the tapered end of said slider and conformed to said longitudinal edges of said slider.

21. The improvement defined in claim 19 wherein said runners are held on the slider adjustably transverse to said longitudinal edges thereof.

22. The improvement defined in claim 21 wherein said runners have a gutter-shaped cross section and the longitudinal edges of said slider are engaged in said runners and detachably secured thereto so that said runners are adjustable transversely to said longitudinal edges of said slider.

23. The improvement defined in claim 4 wherein a feed stabilizer penetrates a cut formed in said fabric web and is attached to said slider, said feed stabilizer being attached to an end of said slider directed in said fabric feed direction.

24. The improvement defined in claim 23 wherein said feed stabilizer is wedge shaped widening in said feed direction of said fabric web.

25. The improvement defined in claim 24 wherein said feed stabilizer is positioned so as to jut out over said fabric web as well as to partially protrude below said fabric web through said cut.

26. The improvement defined in claim 25 wherein said feed stabilizer is beveled on an underside facing said cut in said fabric web, so as to have a bowed side for engaging said cut in said fabric web to provide a more reliable fabric feed.

27. The improvement defined in claim 4 wherein said cutting device and said slider are supported on a feed guide so as to be freely movable transverse to said feed direction of said fabric web.

28. The improvement defined in claim 27 wherein said cutting device is supported on a carriage and said carriage is held on said feed guide movably on guide wheels transverse to said fabric feed direction.

29. The improvement defined in claim 28 wherein two feed bars are provided in side-by-side relation thereto, of which a first feed bar is solely for feeding said cutting device transverse to said fabric feed direction, while said second other feed bar serves to support the weight of said carriage as well as act as a means for feeding said cutting device and said slider mounted on said carriage.

30. The improvement defined in claim 29 wherein a retaining bar is attached to said carriage and extends under one of said feed bars with a retaining roller thereon positioned to engage said feed bar, said retaining bar providing a means for holding said carriage on said feed guide.

31. The improvement defined in claim 30 wherein a plurality of support arms are attached perpendicular to said carriage and extend over said feed bars having guide wheels positioned and attached rotatably thereto so as to contact the upper surfaces of said feed bars so that said carriage and said cutting device can travel easily along said feed guide.

32. The improvement defined in claim 4 wherein a counterslider coextensive with the first mentioned slider engages said web in registry with said first mentioned slider on the opposite side of said web therefrom.

* * * * *